US008672030B2

(12) United States Patent
Sherman

(10) Patent No.: US 8,672,030 B2
(45) Date of Patent: Mar. 18, 2014

(54) SYSTEM FOR CEMENTING TUBULARS COMPRISING A MUD MOTOR

(75) Inventor: Scott Sherman, Blackie (CA)

(73) Assignee: Trican Well Services, Ltd., Calgary (CA)

( * ) Notice: Subject to any disclaimer, the term of this patent is extended or adjusted under 35 U.S.C. 154(b) by 286 days.

(21) Appl. No.: 13/164,336

(22) Filed: Jun. 20, 2011

(65) Prior Publication Data

US 2011/0315380 A1 Dec. 29, 2011

Related U.S. Application Data

(60) Provisional application No. 61/359,718, filed on Jun. 29, 2010.

(51) Int. Cl.
*E21B 33/13* (2006.01)

(52) U.S. Cl.
USPC ..... 166/285; 166/177.4; 166/229; 175/325.4; 175/339

(58) Field of Classification Search
USPC ..... 166/177.4, 250.14, 285, 286, 289, 290, 166/296, 229; 175/317, 325.4, 339
See application file for complete search history.

(56) References Cited

U.S. PATENT DOCUMENTS 5,339,910 A * 8/1994 Mueller ..... 175/61
7,401,648 B2 * 7/2008 Richard ..... 166/278
7,686,100 B2 * 3/2010 Codazzi et al. ..... 175/57

* cited by examiner

*Primary Examiner* — Cathleen Hutchins
(74) *Attorney, Agent, or Firm* — Sean W Goodwin; Linda Thompson

(57) ABSTRACT

A method and system for cementing a tubular and mud motor in a wellbore utilizing burst disks above the mud motor. The burst disks rupture to permit the cement to flow through the burst disks and bypass the mud motor. All of the burst disks reliably rupture at a predetermined and known threshold pressure so as to permit cement to be pumped at a desired rate through all of the ruptured burst disks. Each burst disk is provided with a cover for maintaining a chamber of a known pressure between the cap and the burst disk. All of the burst disks predictably and reliably rupture at the rated pressure.

12 Claims, 6 Drawing Sheets

SYSTEM FOR CEMENTING TUBULARS COMPRISING A MUD MOTOR

CROSS REFERENCE TO RELATED APPLICATIONS

This application is a regular application claiming priority of U.S. Provisional Patent application Ser. No. 61/359,718, filed on Jun. 29, 2010, the entirety of which is incorporated herein by reference.

FIELD OF THE INVENTION

Embodiments of the invention are related to systems, apparatus and methods used during cementing of tubulars in a wellbore and, more particularly, to cementing tubulars which comprise a mud motor while minimizing the amount of cement passing through the mud motor.

BACKGROUND OF THE INVENTION

In oil and gas well drilling operations it is necessary to cement various tubular members to a subterranean formation at different points during the well drilling and completion operations. This practice is well known for various purposes, such as anchoring a surface casing to the earth to provide a solid leak-free top section of the well, and, in the lower portions of the well, to provide isolation between different subterranean zones.

Many wells are now drilled in deviated or non-vertical directions. This practice often utilizes a mud motor to rotate the drill bit without the need to rotate the entirety of the drill string. Conventional mud motors are run on a work string and are retrieved from the wellbore before the string of tubulars, typically casing, is run in the hole.

Applicant is aware that a third party has developed a mud motor that is relatively inexpensive and can be abandoned in the wellbore. This disposable mud motor is run on the end of the casing string.

During cementing operations, it is desired that the cement slurry not be pumped through the mud motor so as to prevent the mud motor from continuing to rotate. Further, mud motors have a high pressure differential across motor which may adversely affect the rate at which the cement is pumped and delivered to the annulus between the casing and the wellbore.

In order to facilitate cementing around, rather than through, a mud motor, the cement must be able to pass from a bore through the casing string to the exterior of the casing string and then be able to pass around the exterior of the mud motor. To accomplish this, ports are provided in a wall of the casing to allow cement to pass therethrough. As will be appreciated by one of skill in the art, a hole drilled through the wall is insufficient. There are many steps in the drilling process where having ports open between the interior and exterior of the casing would be undesirable. It is known that the timing of opening of ports in the casing must be controllable.

Prior art solutions have used conventional burst disks to control the opening of the ports using a predetermined pressure. Once the burst disks, positioned above the mud motor have ruptured, cement flowing down the bore of the casing exits the casing wall through the open ports created thereby for flowing the cement around, rather than through, the mud motor.

Applicant has found however, that conventional burst disks do not open reliably. Further, where a plurality of burst disks are used, if a first burst disk or a relatively small number of the plurality of disks burst, the pressure in the casing bore is relieved as the fluid flows to the wellbore, and thereafter, the pressure does not meet the threshold required to burst the remainder of the burst disks. One solution has been to attempt to significantly increase the pumping rate such that the resulting pressure is adequate to result in rupture of more of the burst disks.

Cementing operations typically require a relatively high pumping rate to ensure cement is pumped downhole through the casing bore and returned toward surface through the annulus between the casing and the wellbore. With only a single port or a small number of ports open through the ruptured burst disk or disks, the flow rate of cement is restricted to that possible through a openings or ports created by the rupture of the single burst disk or small number of disks.

Clearly there is a need in the industry for apparatus that reliably opens to permit pumping of cement through the work string, at a relatively high pumping rate, so as to flow around the mud motor and into the annulus between the casing and the wellbore.

SUMMARY OF THE INVENTION

Embodiments of the invention utilize two or more burst disks located at or above a mud motor in a tubular string to permit cement to flow therethrough, once ruptured, and substantially bypass the mud motor.

A cap is spaced above the burst disk for forming a chamber therebetween. The chamber remains at a substantially fixed and known pressure, such as about atmospheric pressure, when the tubular string is run into the wellbore. Thus, each of the two or more burst disks is unaffected by the variable hydrostatic pressure of fluids in the annulus. As all of the rupture disks will rupture at substantially the same threshold pressure, forming two or more open ports, pumping of cement is possible at a desired, relatively high pumping rate, which is greater than a pumping rate through a single, open port formed by a single ruptured burst disk, typical of the prior art.

In a broad aspect, a method for cementing a tubular conveyance string in a wellbore traversing a subterranean formation, comprises drilling the wellbore with a mud motor supported on the tubular conveyance string and forming an annulus therebetween. The tubular conveyance string has a bore and two or more burst disks fit to the string at or uphole of the mud motor. Each of the two or more burst disks has a cap spaced radially outward from the burst disk for forming a chamber therebetween. The chamber is maintained at a substantially fixed and known pressure, the two or more burst disks having a same threshold pressure at which the two or more burst disks rupture. The mud motor is abandoned downhole. Cement is pumped downhole in the bore of the conveyance string. The bore is pressurized to the threshold pressure for rupturing the two or more burst disks for forming two or more open ports therethrough. Thereafter, cement is continued to be pumped downhole in the bore of the conveyance string and through the two or more open ports to the annulus.

In another broad aspect, a system for completion of a wellbore traversing a subterranean formation comprises a mud motor having a drill bit and supported by a tubular conveyance string having a bore and forming an annulus with the wellbore. Two or more burst disks are fit to the string at or uphole of the mud motor, each of the two or more burst disks having a threshold pressure at which the burst disk ruptures. A cap is spaced radially outward from the burst disk for forming a chamber therebetween, the chamber being maintained at a substantially fixed and known pressure. When the drilling of the wellbore is stopped and cement is pumped downhole through the bore of the conveyance string, the pressure of the cement at the two or more burst disks reaches the threshold pressure for rupturing the two or more burst disks and forming two or more open ports therethrough for delivering the cement to the annulus.

BRIEF DESCRIPTION OF THE DRAWINGS

FIG. 3A illustrates a single bore having a burst disk formed at a base of the bore; and FIG. 3B illustrates a bore and a counterbore having a burst disk formed at a base of the counterbore;

DETAILED DESCRIPTION OF THE PREFERRED EMBODIMENT

Figure 1:
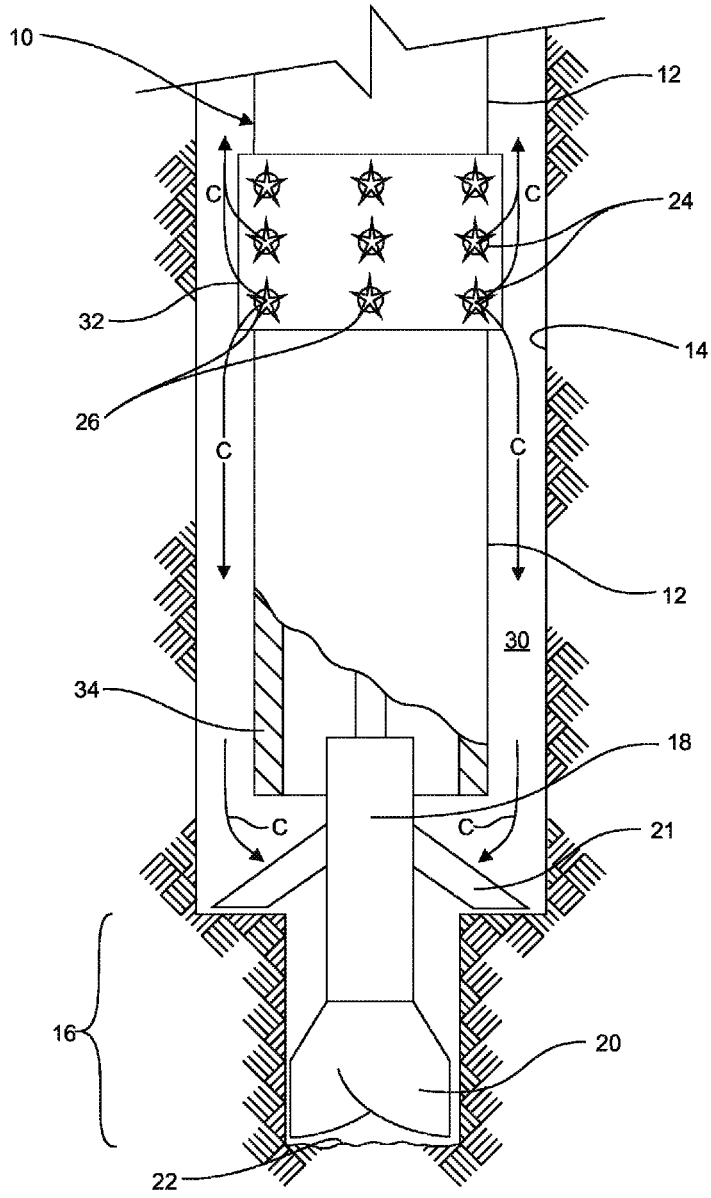
FIG. 1 is a longitudinal, partial cross-sectional view of a casing-while-drilling operation wherein a mud motor is used for driving a drill bit for advancing the wellbore and casing into a formation, ruptured burst disks, according to one embodiment, being illustrated fancifully for forming rupture ports for release of cement therethrough.

As shown in FIG. 1, embodiments are shown in the context of casing-while-drilling operations. A tubular conveyance string 10, typically a string of tubulars 12 forming a liner or casing string, is advanced into a wellbore 14 using a bottom hole assembly 16 having a mud motor 18 connecting the casing string 10 to a drill bit 20, as is known in the art. Once the casing 10 has reached a bottom 22 of the wellbore 14, the casing 10 is cemented into place. The mud motor 18 is not retrieved from the wellbore 14, but is, instead, abandoned at the bottom 22 of the wellbore 14.

Figure 2:
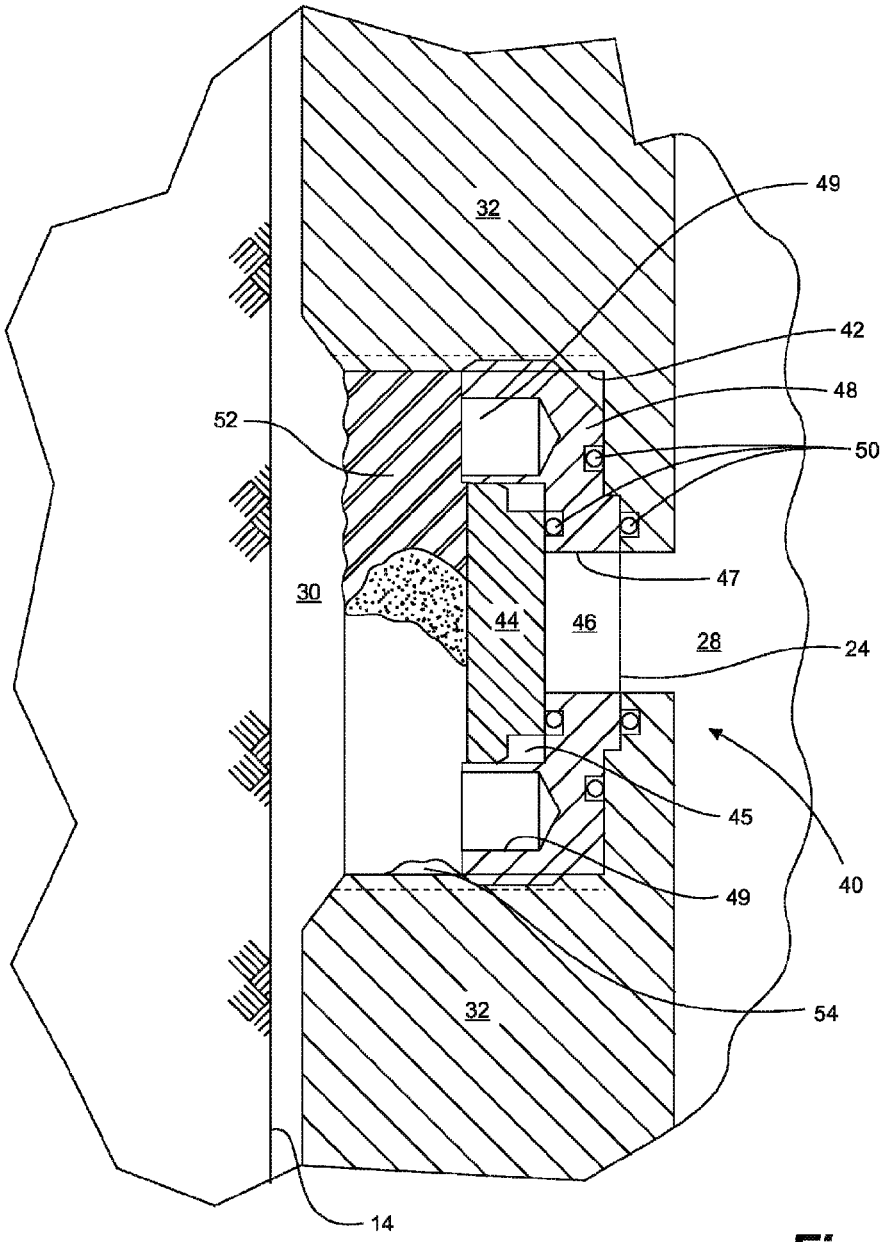
FIG. 2 is a longitudinal section view of a wall of a casing string having a burst port assembly comprising a burst disk according to an embodiment of the invention installed in the casing string wall, an optional protective mastic shown partially covering a cap spaced from the burst disk.

In one embodiment, as shown in FIGS. 1 and 2, two or more burst disks 24 are incorporated into the casing 10 uphole of the mud motor 18. The two or more burst disks 24 are designed to rupture at substantially a same threshold pressure P for forming open ports 26 in the casing 10 to permit cement C, flowing downhole through a bore 28 of the casing 10, to exit the bore 28 uphole of the mud motor 18. The cement C enters an annulus 30 between the casing 10 and the wellbore 14 and flows about the mud motor 18 and uphole in the annulus 30 towards surface.

In an embodiment, as shown in FIGS. 1 and 4A to 4D, two or more burst disks 24 are positioned in a casing collar 32 located at or uphole of the mud motor 18. The two or more burst disks 24 can be arranged in a variety of configurations within the collar 32.

A plurality of burst disks 24 can be arranged in one or more circumferentially-extending rows, each disk 24 spaced circumferentially about the collar 32. In one embodiment, a total of fifteen burst disks 24 are arranged in three rows, each row having five burst disks 24 positioned circumferentially about the collar 32 and are spaced from about 60° to about 72° apart. In another embodiment, the disks 24 of each row are staggered circumferentially form each other burst disk 24 in adjacent rows.

In another embodiment, the burst disks 24 are located in axially extending, raised flanges or fins 33 (FIGS. 4A-4D) which are spaced circumferentially about the collar 32. The fins 33 place the burst disks 24 closer to the wellbore 14. Flow passages 35 are formed between the raised fins 33, aiding in the flow of fluids in the annulus 30 past the collar 32. The casing collar 32 can have a variety of lengths which typically range from about 18 inches to about 24 inches long.

More particularly, as detailed in FIG. 2, the two or more burst disks 24 are designed to reliably rupture at about the threshold pressure P, as described in Applicant's co-pending, published PCT application, WO 2010/148494, the entirety of which is incorporated herein by reference. As all of the rupture disks 24 will rupture at substantially the same threshold pressure P, forming two or more open ports 26, pumping of cement C is possible at a desired, relatively high pumping rate, which is greater than a pumping rate through a single, open port 26 formed by a single ruptured burst disk 24, typical of the prior art.

Figure 3A:
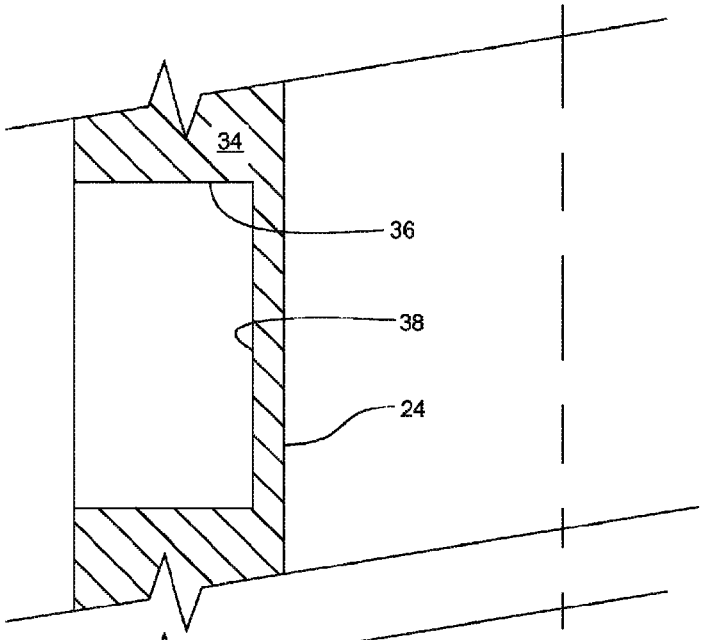
FIGS. 3A and 3B are longitudinal sectional views of a wall of a casing string having a burst disk machined directly into the wall of the casing, a cap being removed for clarity; more particularly.
Figure 3B:
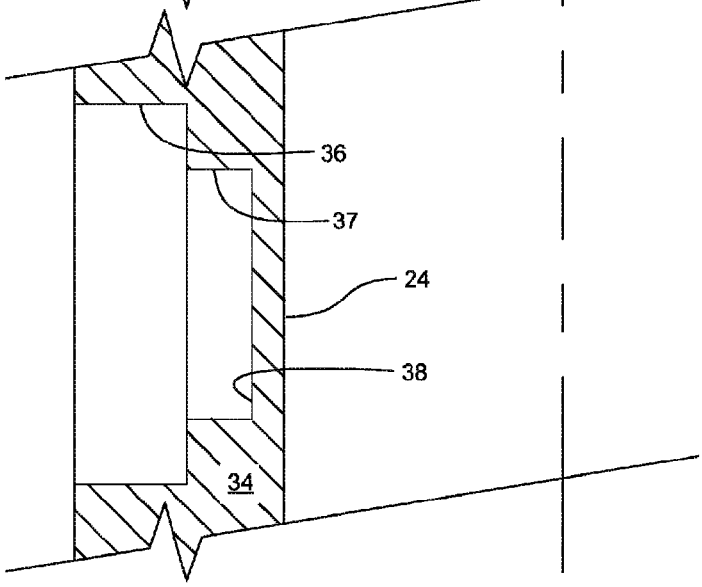
Figure 4A:
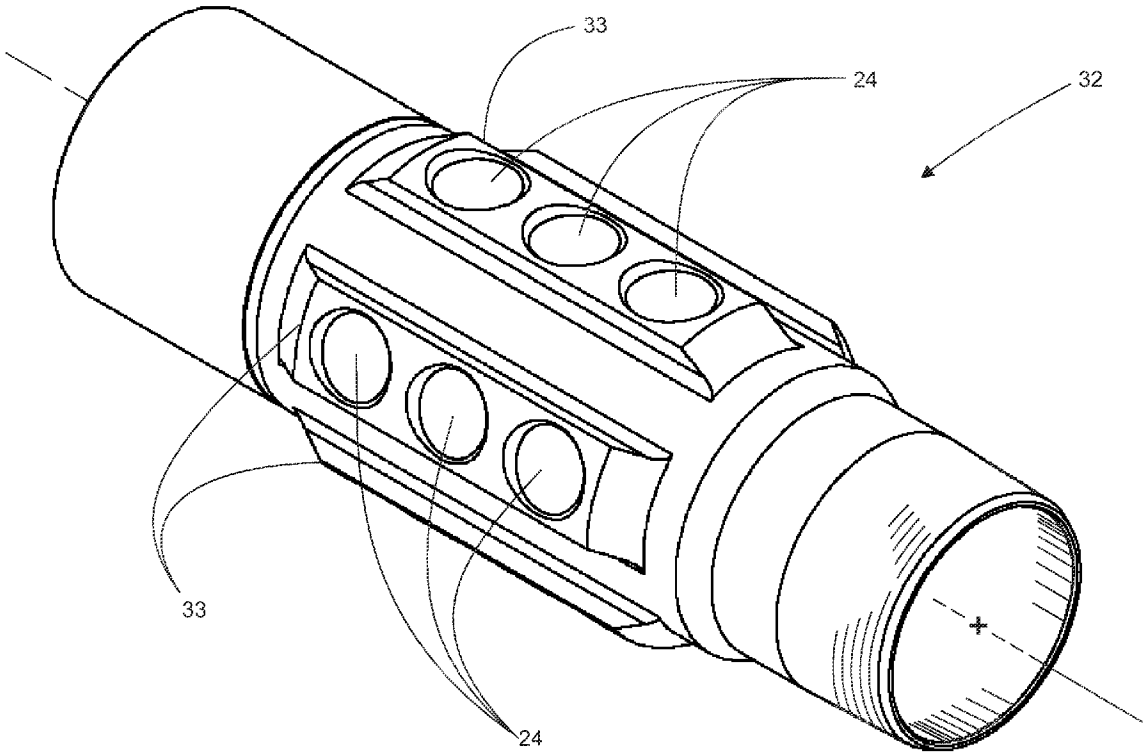
FIG. 4A is a perspective view of a tubular collar having three burst port assemblies fit in each of five fins, the fins extending radially and axially along an outer surface of the collar, the fins being spaced circumferentially thereabout.
Figure 4B:
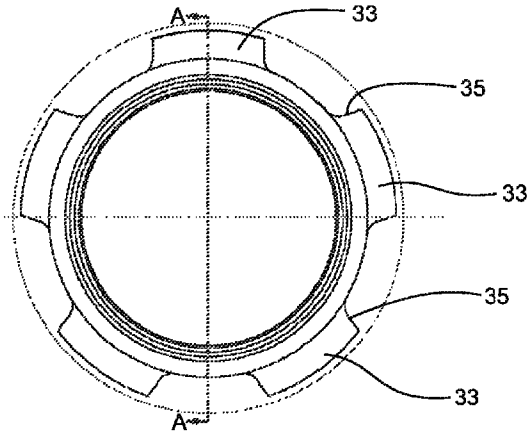
FIG. 4B is an end view according to FIG. 4A.
Figure 4C:
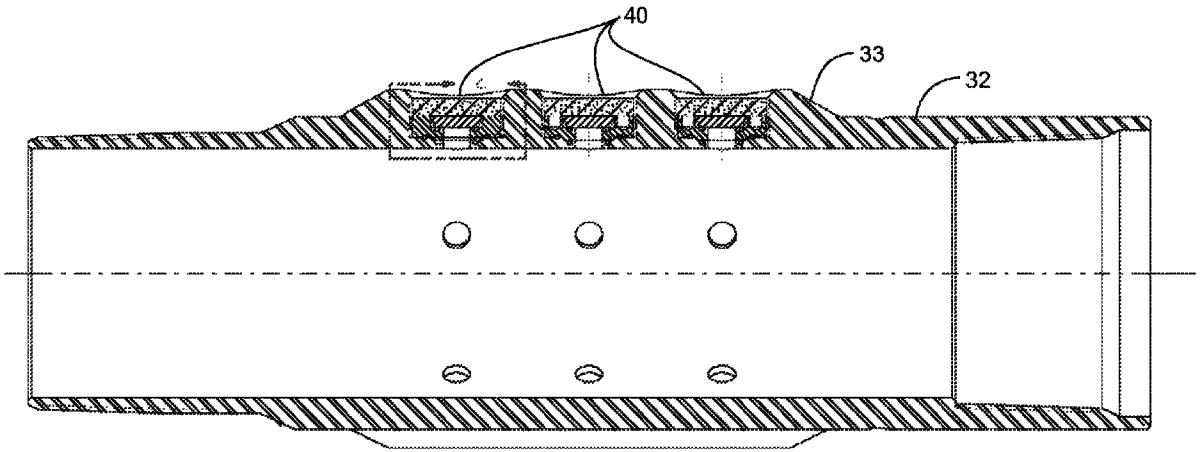
FIG. 4C is a longitudinal cross-sectional view along A-A of FIG. 4B.
Figure 4D:
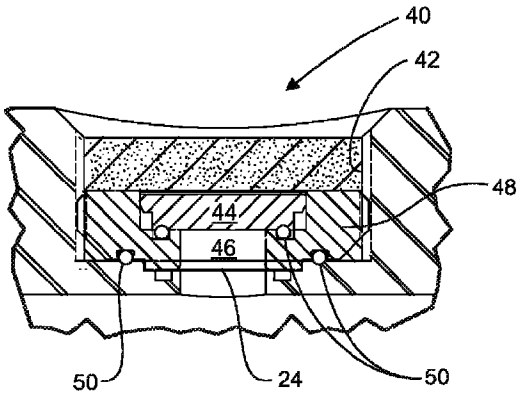
FIG. 4D is a detailed, longitudinal cross-sectional view of a burst port assembly according to FIG. 4B.

In greater detail, as shown in FIGS. 2, 3A and 3B, each burst disk 24 has a thickness and material properties which determine a differential pressure across the burst disk 24 at which the burst disk 24 will rupture. The burst disk 24 can be manufactured from stainless steel or any other suitable material.

Best seen in FIGS. 3A and 3B, the burst disk 24 can be formed directly in a wall 34 of the casing 10 or collar 32, such as by machining a bore 36 in the wall 34, leaving only sufficient material at a base 38 of the machined bore 36 for forming the rupture disk 24. The machined bore 36 can further comprise a counterbore 37 (FIG. 3B)

Alternatively, as shown in FIGS. 2, and 4A to 4D, each burst disk 24 is housed in a burst port assembly 40 which is secured in a burst port 42 formed in the casing wall 34.

A cap 44 is spaced above the burst disk 24 for forming a chamber 46 therebetween. The chamber 46 remains at a substantially fixed and known pressure, such as about atmospheric pressure, when the casing string 10 is run into the wellbore 14. Thus, each of the two or more burst disks 24 is unaffected by the variable hydrostatic pressure of fluids in the annulus 30.

In an embodiment, as the pressure in the chamber 46 can be set at surface, such as at atmospheric pressure, the differential pressure downhole is both known and elevated compared to the prior art in which the hydrostatic pressure in the annulus 30 diminishes the effective differential pressure. Therefore, where the pressure in the chamber 46 is less than the pressure in the annulus 30, the burst disks 24 are more reactive to controlled pressure in the bore 28. Accordingly, the differential pressure at which the burst disk 24 will rupture is determined only by the pressure in the bore 28. As the chamber 46 has a known pressure, each burst disk 24 ruptures reliably at the same threshold pressure P as a pressure in the bore 28 of the casing 10 increases to the threshold pressure P. The pressure in the bore 28 is determined by the cement C pumped downhole therein. The cap 44 is releasably supported above the bust disk 24 such that when the burst disk ruptures, the flow of cement C therethrough into the chamber releases the cap 44, creating the open port 26 to the annulus 30.

Having reference again to FIG. 2 and in an embodiment, the burst port assembly 40 is mounted in the casing 10 and comprises the burst disk 24 which is adjacent the bore 28 of the casing 10. More particularly, the assembly 40 is mounted in the burst port 42 formed in the casing collar 32. The assembly 40 is retained within the burst port 42 by a retainer ring 48. The retainer ring 48 can be threadably engaged in the burst port 42. Wrench-receiving slots 49 are formed in the retainer ring 48 for ease of threading the assembly 40 into the burst port 42. Further, the retainer ring 48 has a stepped bore, having a first bore 47 adjacent the burst disk 24 and a second, larger bore 45 for releasably supporting the cap 44. The cap 44 is press-fit into the second bore 45 of the retainer ring 48 for forming the chamber 46 between the cap 44 and the burst disk 24. Seals 50, such as O-rings, seal between the burst disk 24 and the casing collar 32. Further, seals 50 are provided to seal between the retainer ring 48 and the casing collar 32. Seals 50 are also provided to seal between the retainer ring 48 and the cap 44. Thus, the chamber 46 is sealingly maintained at the known pressure until the burst disk 24 ruptures.

When the pressure within the bore 28 of the casing 10 reaches the threshold pressure P, the burst disk 24 ruptures and the cap 44 is displaced from the retainer ring 48, opening the rupture port 26 through the burst disk assembly 40. Cement C flowing through the casing bore 28 is permitted to pass through the rupture port 26 and into the annulus 30 between the wellbore 14 and the casing thereby substantially avoiding passing through the mud motor 18.

Optionally, a displaceable, protective substance 52, such as mastic, may be used to cover the cap 44. FIG. 2 illustrates a partial fill of protective substance 52 to show both embodiments, one with the protective substance 52 and one without. The protective substance 52 can substantially fill an outer portion 54 of the burst port 42, adjacent the wellbore annulus 30 and covering the cap 44, to ensure the cap 44 is not dislodged or damaged, such as during transport or insertion into the wellbore 14. When the burst disk 24 ruptures, the cement flowing therethrough displaces the cap 44 and the protective substance 52 for providing the open port 26 to the annulus 30.

In Use

As shown in FIG. 1, in order to access zones of interest in a formation, it is well known to drill a wellbore 14 into and traversing through a formation. Further, it is known to use a mud motor 18, operatively connected to and supported by a tubular conveyance string 10 to drive a drill bit 20 and underreamer 21 to drill the wellbore 14. The conveyance string 10 is advanced into the wellbore 14 as the drilling advances. An annulus 30 is formed between the wellbore 14 and the conveyance string 10. When the wellbore 14 has been drilled to the desired depth, the conveyance string 10 is cemented into place by flowing cement into the annulus 30.

In one embodiment of the system, the conveyance string 10 comprises two or more burst disks 24 as described above, and in Applicant's co-pending published PCT application, WO 2010/148494, positioned uphole of the mud motor 18. Before drilling, the cap 44 is installed, charging the chamber 46 with a known pressure, such as atmospheric pressure. Cement is pumped downhole through the bore 28 of the conveyance string 10. The pressure in the bore 28 increases to the threshold pressure P. The pressure can result due to resistance to flow through the mud motor 18 or some other flow restriction. The two or more burst disks 24 rupture, providing open ports 26 through the conveyance string 10. Substantially all of the burst disks 24 rupture as a result of having the threshold pressure P acting on one side and a known pressure, such as atmospheric pressure, in the chamber 46 on the other side. The cement flows out of the open ports 26, into the annulus 30 and around the mud motor 18. As will be appreciated by one of skill in the art, some of the cement may pass through the mud motor 18.

Figure 5:
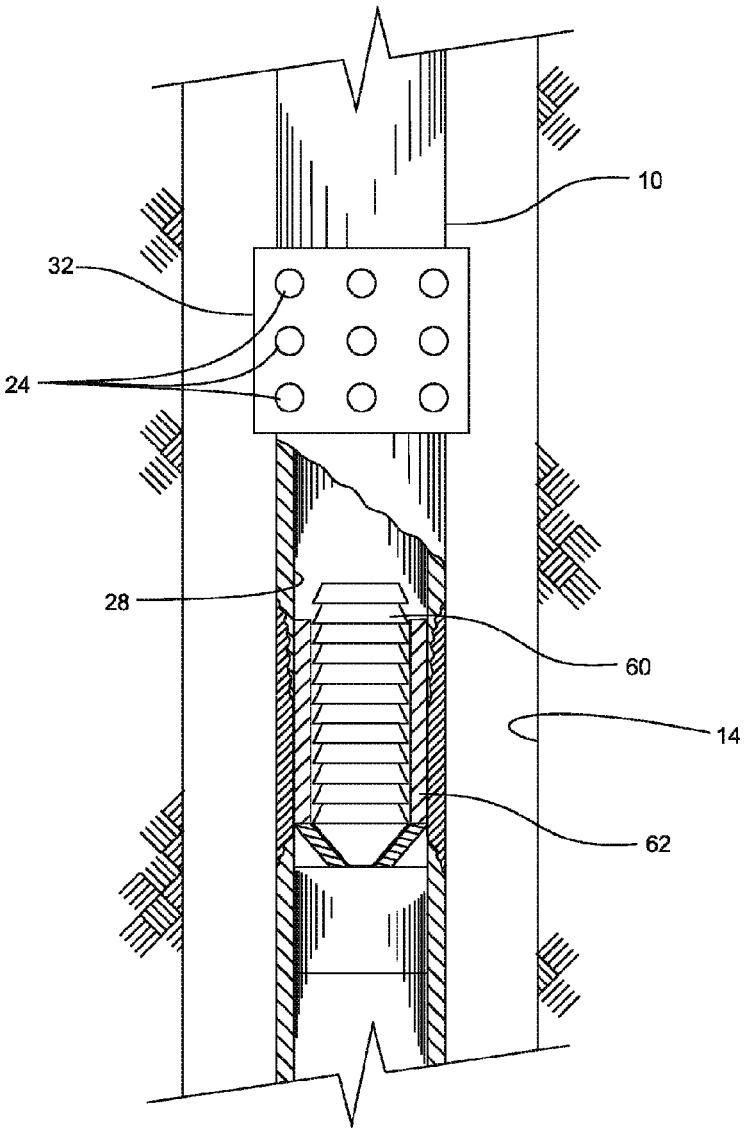
FIG. 5 is a longitudinal, partial cross-sectional view of a latching sub positioned above the mud motor for operatively engaging a wiper plug run into the wellbore in advance of cement.

In another embodiment, as shown in FIG. 5, a plug, such as a wiper plug 60, is run into the bore 28 of the conveyance string 10 in advance of the cement. The wiper plug 60 is engaged in the conveyance string 10 below the two or more rupture disks 24 and at or uphole of the mud motor 18. The wiper plug 60 engages a latching sub 62 connected in the conveyance string 10, and effectively blocks the passage of cement through the mud motor 18 therebelow. Further, as a result of pumping cement downhole against the wiper plug 60, the pressure in the bore 28 is more effectively and reliably increased to reach the threshold pressure P.

Alternatively, in order to minimize flow through the mud motor 18, the mud motor 18 can be stalled, such as by increasing the weight-on-bit (WOB) until the motor 18 stalls. While a small amount of cement might pass through the stalled mud motor 18, pumping cement against the stalled motor 18 will more quickly generate pressure in the bore 28 to reach the threshold pressure P, causing the burst disks 24 to rupture.

EXAMPLE

A wellbore having a total vertical depth (TVD) of 1200 m and a total measured depth (TMD) of 3000 m is drilled using 4.5 inch casing and a bottomhole assembly comprising a mud motor. A hydrostatic pressure of 11.7 MPa in the wellbore results in a calculated, maximum drilling pressure of about 30 MPa.

At or above the mud motor, a casing collar is positioned comprising fifteen burst disks according to an embodiment of the invention. Each of the burst disks has an orifice diameter of about 0.375 inches and a thickness of about 0.006 inches and is designed to have an absolute burst pressure of about 54.6 MPa for each of the burst disks.

In order to rupture substantially all of the burst disks, the pressure within the casing must be increased to a pressure threshold of about 43 MPa, measured at surface, in order to exceed the absolute pressure at which the disks will burst at depth in the wellbore. The burst threshold pressure, at surface, is about 13 MPa greater than the maximum drilling pressure. The difference between the rupture threshold pressure and the drilling pressure acts as a safety margin to ensure the burst disks do not rupture during normal drilling operations.

Once substantially all of the burst disks have ruptured, cement, flowing through the casing bore can be delivered therethrough, bypassing the mud motor and delivering the cement to the wellbore annulus.

The embodiments of the invention for which an exclusive property or privilege is claimed are defined as follows:

1. A method for cementing a tubular conveyance string in a wellbore traversing a subterranean formation, comprising:

drilling the wellbore with a mud motor supported on the tubular conveyance string and forming an annulus therebetween, the tubular conveyance string having a bore and two or more burst disks fit to the string at or uphole of the mud motor, each of the two or more burst disks having a cap spaced radially outward from the burst disk for forming a chamber therebetween, the chamber being maintained at a substantially fixed and known pressure, the two or more burst disks having a same threshold pressure at which the two or more burst disks rupture;

abandoning the mud motor downhole;

pumping cement downhole in the bore of the conveyance string;

pressuring the bore to the threshold pressure for rupturing the two or more burst disks for forming two or more open ports therethrough; and continuing to pump cement downhole in the bore of the conveyance string and through the two or more open ports to the annulus.

2. The method of claim 1, before drilling the wellbore, further comprising:

installing the cap at surface for charging the chamber at the fixed and known pressure.

3. The method of claim 1, before pumping cement downhole, further comprising:

deploying a wiper plug downhole through the bore for blocking the bore between the mud motor and the two or more burst disks.

4. The method of claim 1, before running the conveyance string into the wellbore, further comprising:

covering the cap of each of the two or more burst disks with a displaceable, protective substance.

5. The method of claim 1, before abandoning the mud motor, further comprising:

stalling the mud motor for minimizing flow through the mud motor during cementing.

6. The method of claim 1, wherein the fixed and known pressure is atmospheric pressure.

7. A system for completion of a wellbore traversing a subterranean formation comprising;

a mud motor having a drill bit and supported by a tubular conveyance string having a bore and forming an annulus with the wellbore;

two or more burst disks fit to the string axially adjacent or uphole of the mud motor, each of the two or more burst disks having a threshold pressure at which the burst disk ruptures and a cap, spaced radially outward from the burst disk for forming a chamber therebetween, the chamber being maintained at a substantially fixed and known pressure, wherein when the drilling of the wellbore is stopped and cement is pumped downhole through the bore of the conveyance string, the pressure of the cement at the two or more burst disks reaches the threshold pressure for rupturing the two or more burst disks and forming two or more open ports therethrough for delivering the cement to the annulus.

8. The system of claim 7, wherein the two or more burst disks are uphole of the mud motor, further comprising:

a latching sub, uphole of the mud motor and downhole of the two or more burst disks; and a wiper plug for engaging in the latching sub, wherein when the wiper plug is run into the bore of the conveyance string and engages in the latching sub, the mud motor is blocked for directing the cement through the two or more open ports.

9. The system of claim 7 wherein the two or more burst disks are located in a collar uphole of the mud motor.

10. The system of claim 9 wherein the collar further comprises axially and radially extending fins, spaced circumferentially about the collar, the two or more burst disks being located in the fins, wherein the burst disks are positioned closer to the wellbore; and flow passages are formed between the fins for aiding in passage of cement past the collar.

11. The system of claim 7 wherein each of the two or more burst disks are fit in a wall of the conveyance string in a burst port assembly, the burst port assembly comprising:

a retainer ring for threadably engaging a burst port formed in the wall for supporting the burst disk therebetween and for releasably supporting the cap, spaced radially outward therefrom; and seals for sealing between the burst disk and the wall, between the retainer ring and the wall and between the retainer ring and the cap for maintaining the chamber at the substantially fixed and known pressure.

12. The system of claim 7 wherein the substantially fixed and known pressure is at about atmospheric pressure.

* * * * *